US009422796B2

(12) United States Patent
Daly

(10) Patent No.: US 9,422,796 B2
(45) Date of Patent: Aug. 23, 2016

(54) CASED HOLE CHEMICAL PERFORATOR

(75) Inventor: Kerry Gordon Daly, Conroe, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 651 days.

(21) Appl. No.: 13/607,963

(22) Filed: Sep. 10, 2012

(65) Prior Publication Data

US 2014/0069647 A1 Mar. 13, 2014

(51) Int. Cl.

| | |
|---|---|
| ***E21B 43/112*** | (2006.01) |
| ***E21B 43/114*** | (2006.01) |
| ***E21B 29/02*** | (2006.01) |
| ***E21B 43/11*** | (2006.01) |

(52) U.S. Cl.

CPC ..... *E21B 43/112* (2013.01); *E21B 29/02* (2013.01); *E21B 43/11* (2013.01); *E21B 43/114* (2013.01)

(58) Field of Classification Search

None

See application file for complete search history.

(56) References Cited

U.S. PATENT DOCUMENTS

| | | | | |
|---|---|---|---|---|
| 2,297,038 | A | 9/1942 | Turechek et al. | |
| 4,125,161 | A | 11/1978 | Chammas | |
| 4,180,131 | A | 12/1979 | Chammas | |
| 4,446,920 | A | 5/1984 | Woytek et al. | |
| 5,287,920 | A * | 2/1994 | Terrell | 166/55 |
| 6,591,911 | B1 | 7/2003 | Markel et al. | |
| 7,337,844 | B2 | 3/2008 | Surjaatmadja et al. | |
| 8,869,898 | B2 * | 10/2014 | Xu et al. | 166/308.1 |

FOREIGN PATENT DOCUMENTS

| | | |
|---|---|---|
| EP | 0575114 A1 | 12/1993 |
| GB | 2448629 A | 10/2008 |

OTHER PUBLICATIONS

Patent Examination Report No. 1 in counterpart Australian Appl. 2013221946, dated Mar. 17, 2015.

First Office Action in counterpart Canadian Appl. 2,825,325, dated Mar. 19, 2015.

Extended Search Report in counterpart EP Appl. 13183716.3, dated Jan. 27, 2016.

* cited by examiner

*Primary Examiner* — Jennifer H Gay
*Assistant Examiner* — Caroline Butcher
(74) *Attorney, Agent, or Firm* — Blank Rome LLP

(57) ABSTRACT

A device and method for use is provided to provide a port in a tubular without using explosives or a mechanical apparatus. By the utilization of the chemical cutter described herein the decision on the type of completion equipment to be implemented may be delayed or modified as the well creation progresses.

29 Claims, 5 Drawing Sheets

CASED HOLE CHEMICAL PERFORATOR

BACKGROUND

In drilling oil and gas wells, after a productive hydrocarbon zone has been reached it is often necessary to run a well casing into the wellbore. The casing is then anchored into place by injecting a volume of cement into the annulus between the wellbore wall and the casing. The cement anchors the casing into place and seals the hydrocarbon zone to prevent the migration of fluids from one zone to another through the annular space. Unfortunately, the casing blocks the flow of formation fluid, in particular hydrocarbons, into the interior of the casing.

In order to produce the hydrocarbons from a wellbore, it is necessary to provide a series of lateral perforations through the casing and any adjacent cement. In many instance a perforation gun is used to perforate the casing and the adjacent cement.

A perforation gun may use a series of shaped charges to perforate the casing. The perforation gun is lowered into the vicinity of the casing that is desired to be perforated and, upon actuation of the perforation gun from the surface, the shaped charge is fired, penetrating the casing and adjacent cement. After the casing has been perforated approximately adjacent to a hydrocarbon producing formation the formation is typically fractured or otherwise treated to enhance the production of hydrocarbons from the zone.

Presently it is becoming more common to drill through multiple zones with a single wellbore and due to the structure of the formation zones long horizontal sections are increasingly becoming the typical method of drilling a well. As horizontal completions become increasingly common, it is desirable, due to the high cost of standby time for the fracturing and well treating equipment, to minimize the time required to set up and complete the treatment or fracturing of one hydrocarbon producing zone and move to the next hydrocarbon producing zone in the same wellbore.

One method of decreasing the high cost of standby time for the fracturing and well treating equipment, that has been developed is to incorporate sliding sleeves with ball valves into the casing string and then to cement the tubular in place including the sliding sleeves. With sliding sleeves cemented into place a perforating gun is not necessary as ports are provided in the sliding sleeves. When it becomes necessary to open a sliding sleeve a ball or other plug is circulated downhole to open the sleeve allowing the operator to fracture or treat the desired hydrocarbon producing zone.

The drawback to such a system is that the decision to complete the well with sliding sleeves must be made relatively early, a complete system must be purchased, and the complete system should be precisely incorporated into the tubular assembly to correspond with each hydrocarbon producing zone.

SUMMARY

One embodiment of the present allows the operator to decide how to complete the well even after the well has been cased. By employing open-hole sliding sleeve technology. Previously the use of sliding sleeve technology has not been possible because there has not been a means to perforate the casing adjacent to the ports in the sliding sleeve. However, by using a chemical cutter such as bromine trifluoride with a steel wool catalyst, a self-contained chemical-filled cartridge may be positioned within the sliding sleeve at the preferred well location. To activate the sleeve and its associated chemical cutter a ball may be circulated to move the chemical perforator radially outward against the casing. Additional pressure ruptures the cartridge, forcing the chemical to contact the steel wool and start the oxidizing reaction. Continued pressure drives this reaction against the casing in a focused jet to create a through-hole perforation in the casing. One the sliding sleeve is open and the casing is perforated the hydrocarbon producing formation may then be treated. The steel wool catalyst may be particles of iron.

DETAILED DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
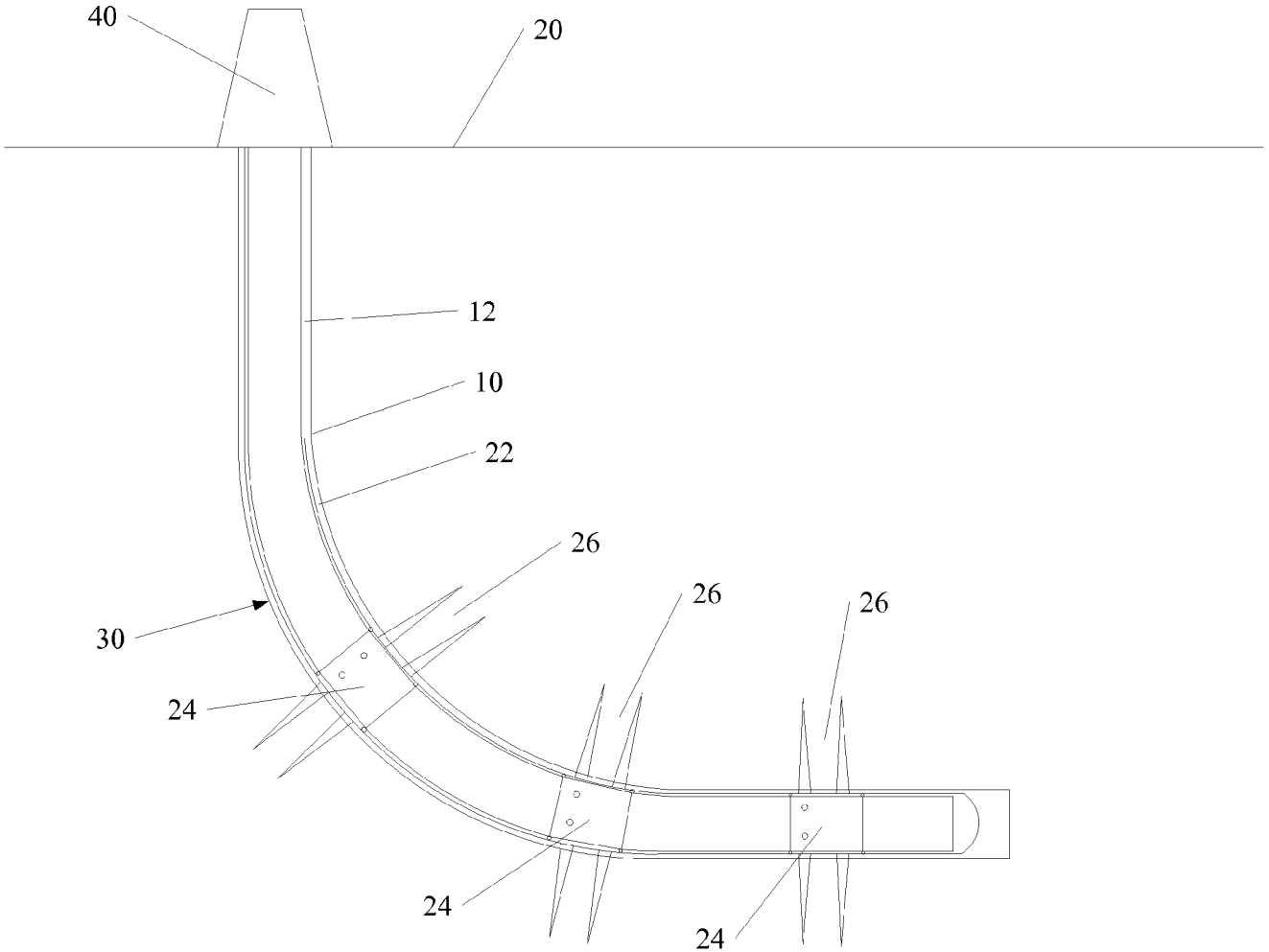
FIG. 1 depicts a cased wellbore with a tubular assembly.

FIG. 1 depicts a wellbore 10 in which casing 12 where cement has been pumped through the casing 12 from the surface 20. The cement is forced out of the bottom of the casing and then flows back up towards the surface 20 through the annulus 22 between the casing and the wellbore 10. Once the annulus 22 is filled with cement the cement is allowed to set anchoring the casing 12 into place in the wellbore 10.

The operator may then run a tubular assembly 30 into the casing 12. The tubular assembly is assembled on the surface 20 and run into the casing by rig 40 so that each desired perforating sleeve 24 may be adjacent to a portion of a hydrocarbon producing formation 26. Once the perforating sleeves 24 are properly located the perforating sleeves 24 may be actuated. Many operators may choose to activate each perforating sleeve 24 independently such as by using differently sized balls to actuate each perforating sleeve 24 or by using any of the methods whereby a single ball may actuate a particular perforating sleeve 24. In certain instances the operator may choose to actuate all of the perforating sleeves 24 with a single ball. It should be understood that while an actuating ball is referred to throughout, an actuating dart, plug or any other device that may actuate the perforating sleeve 24 may be used.

Figure 2:
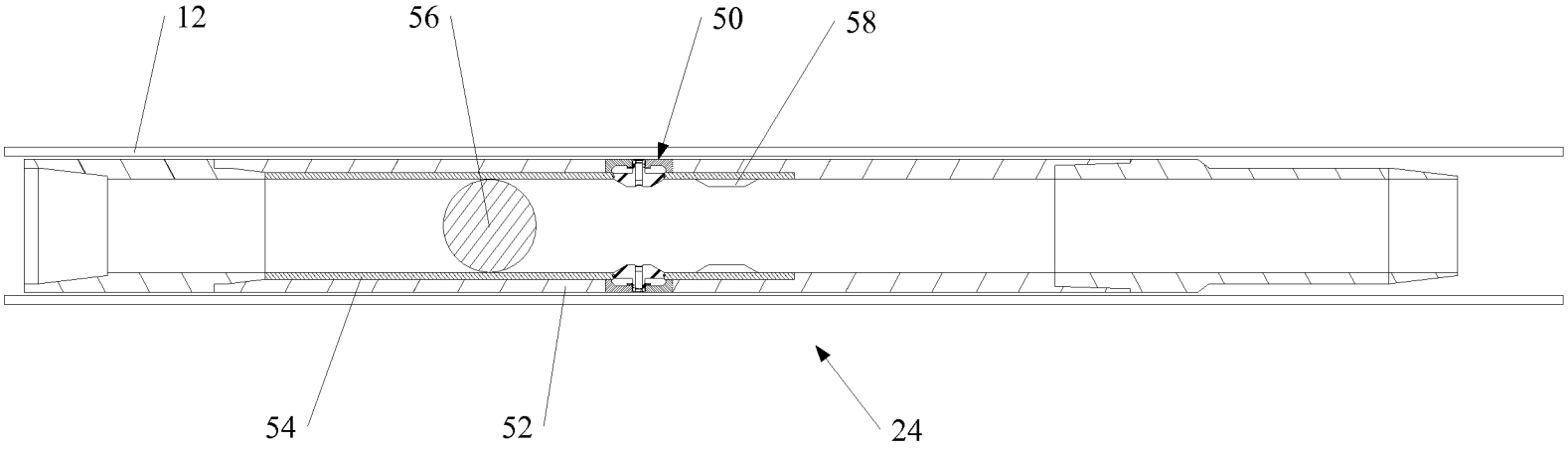
FIG. 2 depicts a single perforating sleeve located in casing.

FIG. 2 depicts a single perforating sleeve 24 located in casing 12. The perforating sleeve 24 is has a perforating assembly 50 located in the housing 52. A separate inner sleeve 54 may be incorporated to fix the perforating assembly's 50 components in place. In some instances the inner sleeve 54 may not be used and the perforating assembly may be fixed directly to the housing 52 by threads, screws, welding, brazing, press fit into position or any other means known in the industry. In many instances the inner sleeve 54 may not be fixed into position but may be longitudinally movable to close or open the port through the housing and casing that is created by the operation of the perforating assembly 50. A ball 56 is sized so that the ball 56 will actuate the perforating assembly 50 by a portion of the perforating assembly 50 radially outward as the ball 56 passes the perforating assembly. The perforating sleeve 24 has a fixed ball seat 58 to catch the ball 56 after the perforating assembly 50 has been actuated. After the perforating assembly 50 creates a port in the casing 12 and the perforating sleeve 24 pressure from the surface 20 may be applied to the ball 56 on seat 58 to fracture or otherwise treat the adjacent hydrocarbon zone 26. In certain perforating sleeves the seat 58 may not be rigidly fixed to the perforating sleeve 24.

Figure 3:
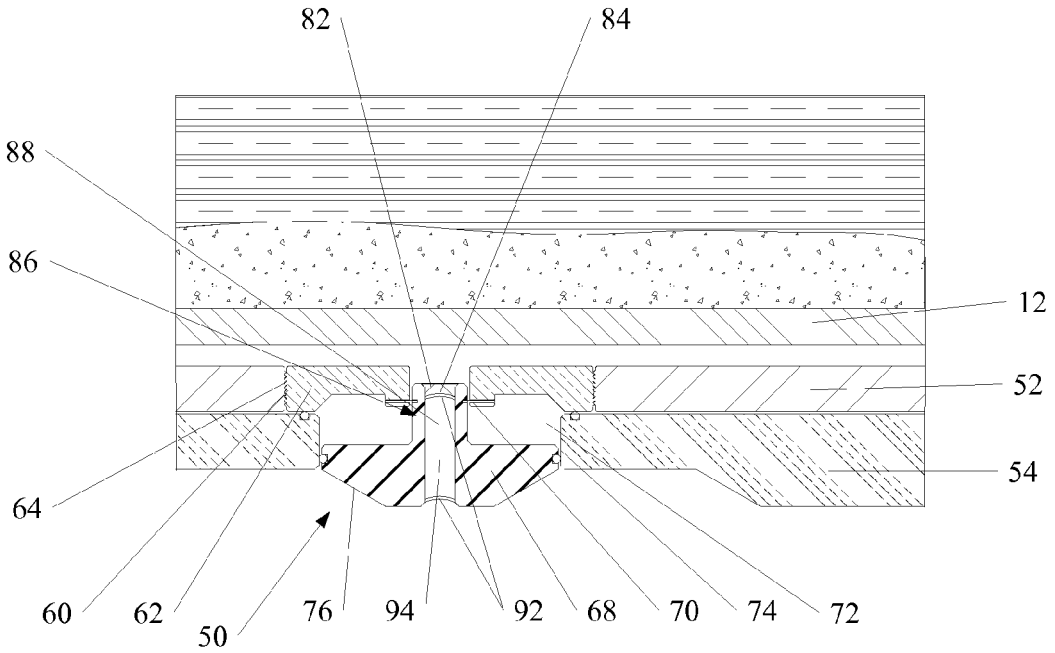
FIG. 3 depicts a perforating assembly in its initial state being run into the casing.

FIG. 3 depicts a perforating assembly 50 in its initial state as it is being run into the casing 12. The perforating assembly 50 is depicted as being screwed into housing 52 via threads 60 on the perforating assembly base 62 and corresponding threads 64 on the housing 50. The perforation cartridge 68 is held in its set position by shear pins 70. While shear pins 70 are depicted any known means of retaining the perforation cartridge 68 in its set position such as shear screws, adhesives, or friction could be used. The shear pins 70 hold the perforation cartridge 68 such that a portion of the perforation cartridge 68 protrudes radially inward into the interior bore of the perforation sleeve 24. The portion of the perforation cartridge 68 that protrudes into the interior bore of the perforation sleeve 24 may have a sloping profile 76 so that when a ball, such as ball 56, contacts the perforation cartridge the force that the ball 56 can apply to the perforation cartridge 68 may be magnified. The perforation cartridge 68 is located in a bore 72 in the inner sleeve 54. The shoulders 74 of the bore 72 may serve as a guide so that when ball 56 strikes the sloping profile 76 the perforation cartridge 68 will be driven radially outward with little longitudinal offset.

The perforation cartridge 68 also has a penetrator assembly 86. The perforation cartridge 68 may have a bore 88 through the perforation cartridge 68 to retain the penetrator assembly 86. The bore 88 may have a protective membrane 82 located on the bore opening furthest from the centerline of the penetrator sleeve 24. The protective membrane may be an elastomer, a metal, or any material that will retain and protect the catalyst 84 in the bore 88. In certain instances no protective membrane 82 may be required. The catalyst is useful to increase the effects of the chemical penetrator 94 and depending upon the chemical penetrator 94 is typically steel wool. High pressure rupture disks 92 are located at the innermost end of the bore 88 and between the catalyst and the chemical penetrator 94. The chemical penetrator is retained in the bore 88 by the high pressure rupture disks 92. Typically the chemical penetrator 94 is bromine trifluoride although any chemical that may erode the casing 12 may be used.

Figure 4:
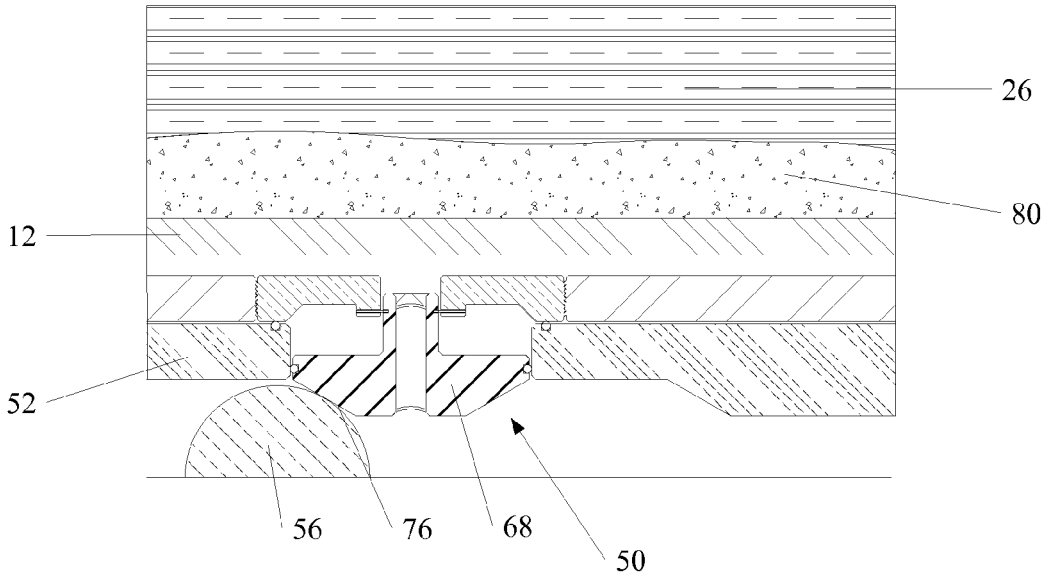
FIG. 4 depicts the perforation assembly as the ball strikes the perforation cartridge but before actuating the perforation cartridge.

FIG. 4 depicts the perforation assembly 50 and a portion of the surrounding perforation sleeve 24, casing 12, cement 80, and hydrocarbon producing formation 26 as the ball 56 strikes the sloping profile 76 of the perforation cartridge 68 but before the perforation cartridge 68 can move.

Figure 5:
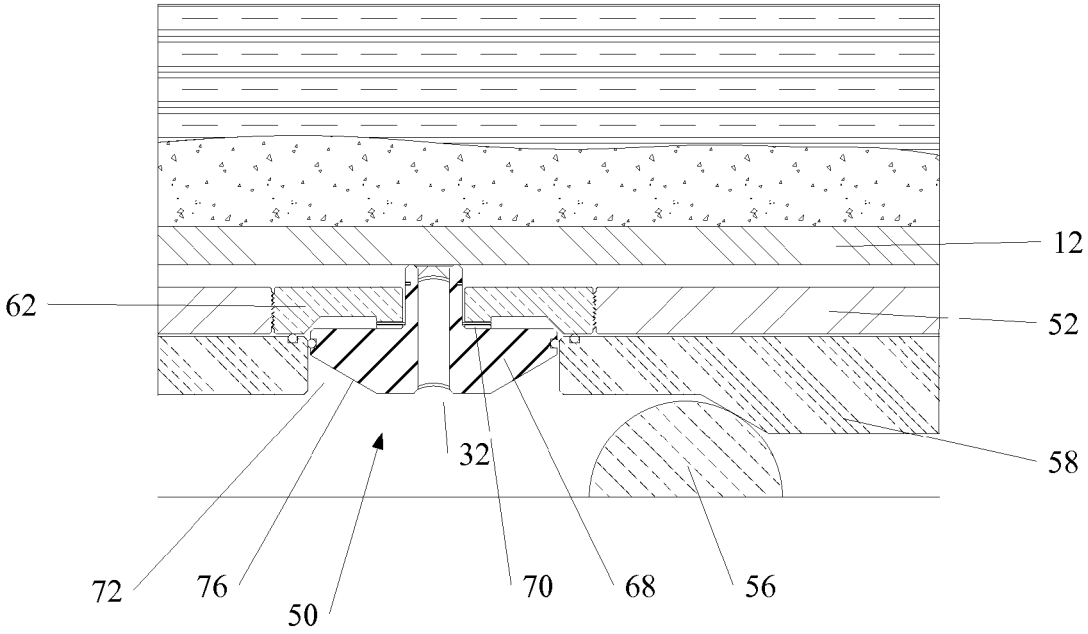
FIG. 5 depicts the perforation assembly just after the ball has impacted the perforation cartridge.

FIG. 5 depicts the perforation assembly 50 just after the ball 56 has impacted the perforation cartridge 68. Pressure is applied from the surface 20 through the rig 40 to force the ball 56 to shear the shear pins 70 and move the perforation cartridge 68 radially outward. The perforation cartridge 68 has moved radially outward in the perforating assembly base 62 so that sloping profile 76 is fully recessed into the bore in the inner sleeve 52 and the furthest radially outward portion of the perforation cartridge 68 contacts the casing 12. After the ball 56 has forced the perforation cartridge 68 into the recess 72 the ball 56 continues down the tubular assembly until it seats on seat 58.

Figure 6:
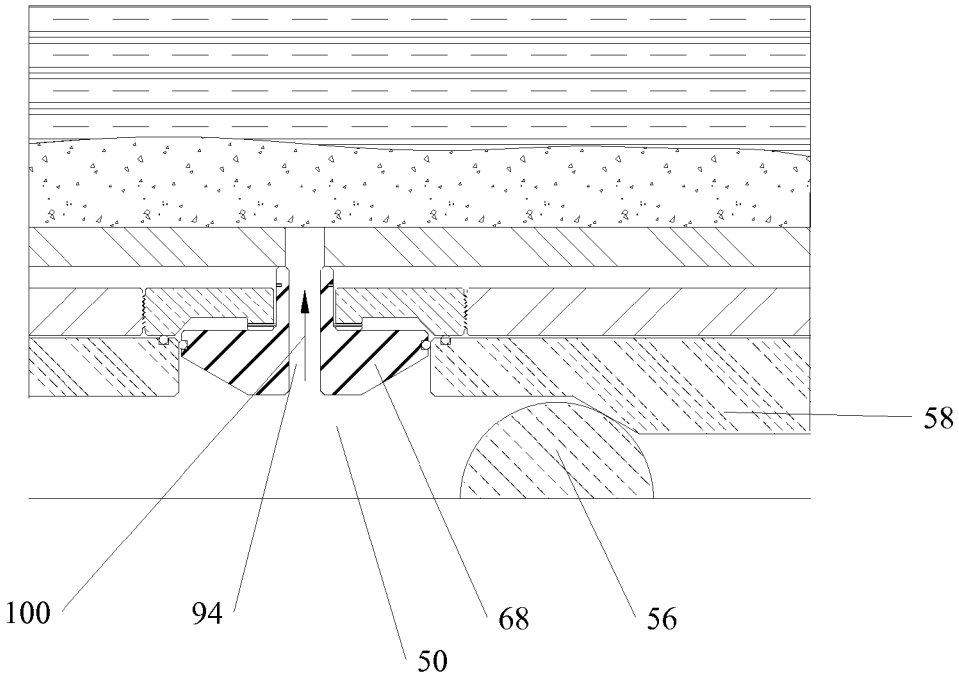
FIG. 6 depicts the perforation assembly after the ball has moved the perforation cartridge radially outwards against the casing.

FIG. 6 depicts the perforation assembly 50 shortly after the ball 56 has moved the perforation cartridge 68 radially outwards against the casing 12. Continued pressure from the surface 20 should cause both of the high pressure rupture disks 92 and the protective membrane 82 to break. Once the high pressure rupture disks 92 break the chemical penetrator 94 and the catalyst 84 to come into contact with one another. The pressure from the surface 20 will also cause the chemical penetrator 94 and the catalyst 84 to move in the direction of arrow 100 allowing the chemical penetrator 94 to interact with the catalyst 84.

Figure 7:
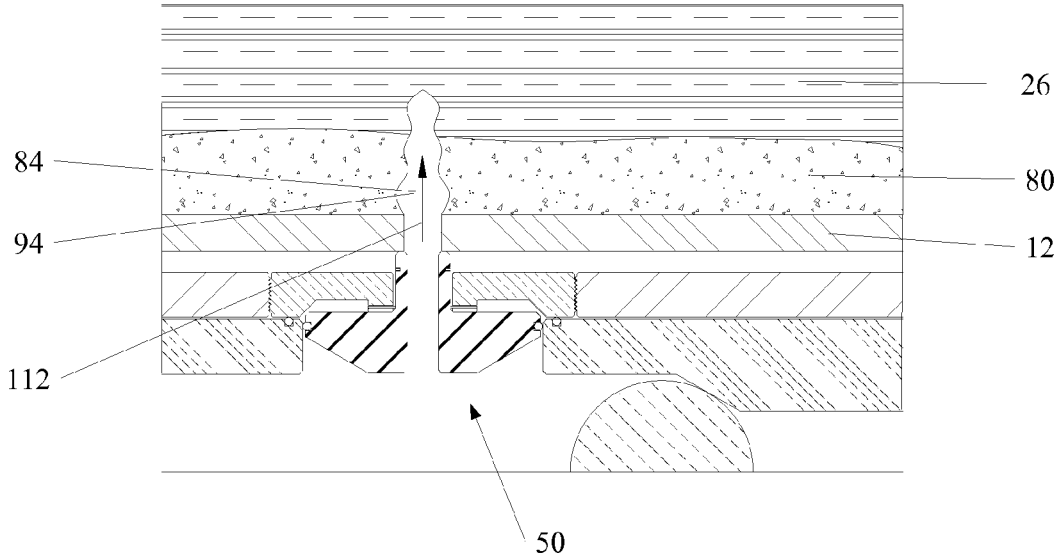
FIG. 7 depicts the perforation assembly as continued pressure from the surface forces the chemical penetrator and the catalyst against the casing.

FIG. 7 depicts the perforation assembly 50 as continued pressure from the surface 20 continues to force the chemical penetrator 94 and the catalyst 84 mixture in the direction of arrow 112 against the casing 12 where it penetrates through the casing and at least to the cement 80. Further pressure from surface 20 in addition to the chemical penetrator 94 and the catalyst 84 mixture will penetrate the cement 80. The hydrocarbon producing formation 26 may then be treated so that production may be optimized.

Figure 8:
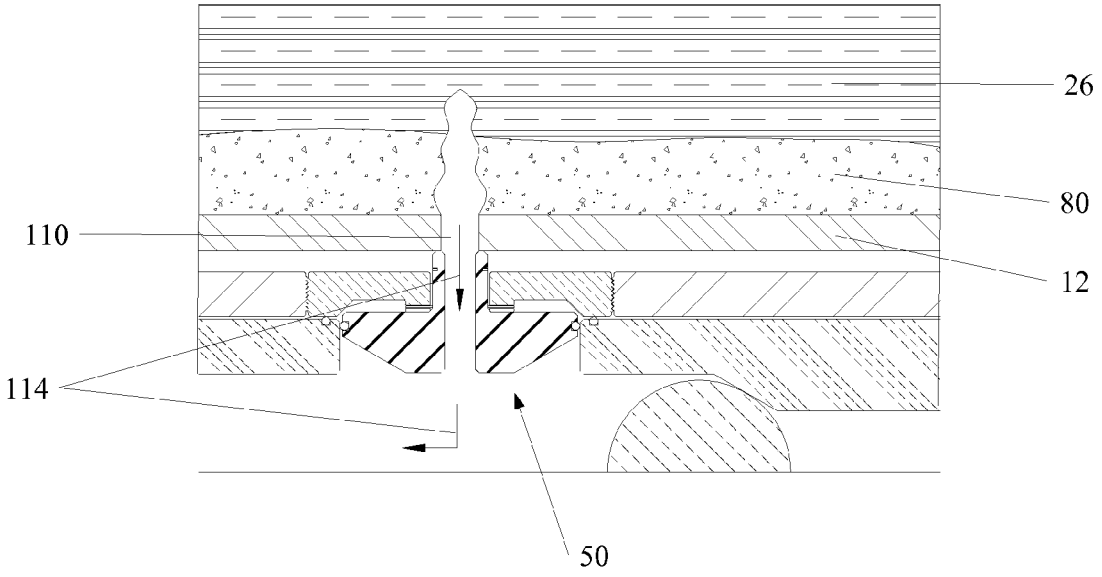
FIG. 8 depicts production from the hydrocarbon producing formation through the port cut in the casing by the penetrator assembly.

FIG. 8 depicts production from the hydrocarbon producing formation 26 through the cement 80 and through the port 110 in the casing 12 that was cut by the penetrator assembly 50. The direction of production is shown by arrows 114.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A perforating sleeve adapted to create a port through a casing of a wellbore in which the perforating sleeve is disposed, the perforating sleeve comprising:

an outer housing; and a perforating assembly secured within the outer housing and comprising a perforating cartridge having a first portion disposed within a wall of the outer housing and a second portion protruding into an interior bore of the perforating sleeve, the perforating cartridge having a bore therethrough containing a chemical penetrator;

wherein the second portion of the perforating cartridge protruding into the interior bore of the perforating sleeve provides a bearing surface that upon engagement with an actuating device pumped through the perforating sleeve causes the perforating cartridge to be moved radially outwardly toward the casing; and wherein pressure applied within the inner bore of the perforating sleeve after the radially outward movement of the perforating cartridge causes the chemical penetrator to react with the casing to create a port therethrough.

2. The perforating sleeve of claim 1 further comprising:

an inner sleeve disposed within the outer housing, the inner sleeve being arranged to secure the perforating assembly within the outer housing and being further arranged to be longitudinally movable within the outer housing to close or open the created port.

3. The perforating sleeve of claim 2 wherein the perforating cartridge is located in a bore of the inner sleeve having shoulders that serve as a guide so that when the actuating device engages the bearing surface the perforating cartridge will be driven radially outwardly with little longitudinal offset.

4. The perforating sleeve of claim 1 wherein the perforating assembly is secured within the outer housing by threads, screws, welding, brazing, or press fitting.

5. The perforating sleeve of claim 4 wherein the perforating assembly is secured within the outer housing by threads on a base of the perforating assembly that engage complimentary threads on the outer housing.

6. The perforating sleeve of claim 1 wherein the perforating assembly is radially retained by one or more shear pins, by an adhesive, or by friction.

7. The perforating sleeve of claim 6 wherein the perforating assembly is radially retained by shear pins.

8. The perforating sleeve of claim 1 wherein the actuating device is a ball.

9. The perforating sleeve of claim 8 wherein the bearing surface provided by the second portion of the perforating cartridge protruding into the interior bore of the perforating sleeve has a sloped profile that magnifies the force that the ball can apply to the perforating cartridge.

10. The perforating sleeve of claim 1 wherein the bore through the perforating cartridge further comprises a catalyst that increases the effects of the chemical penetrator on the casing.

11. The perforating sleeve of claim 10 wherein the catalyst and chemical perforator are separated by a protective membrane that is ruptured by the pressure applied within the inner bore of the perforating sleeve after the radially outward movement of the perforating cartridge.

12. The perforating sleeve of claim 11 wherein the protective membrane is an elastomer.

13. The perforating sleeve of claim 11 wherein the protective membrane is a metal.

14. The perforating sleeve of claim 10 wherein the chemical penetrator is bromine trifluoride and the catalyst is steel wool.

15. The perforating sleeve of claim 14 wherein the bromine trifluoride is retained within the bore of the perforating cartridge by a rupture disk located in the bore of the perforating cartridge radially inward with respect to the perforating sleeve and by a second rupture disk located between the bromine trifluoride and the steel wool, wherein the steel wool is located in a portion of the bore of the perforating cartridge radially outward with respect to the perforating sleeve, wherein the rupture disks are ruptured by the pressure applied within the inner bore of the perforating sleeve after the radially outward movement of the perforating cartridge.

16. The perforating sleeve of claim 1 wherein the bore through the perforating cartridge further comprises a catalyst that increases the effects of the chemical penetrator on the casing, wherein the chemical penetrator is bromine trifluoride and the catalyst is steel wool.

17. A method of chemically perforating a casing of a wellbore, the method comprising:

disposing within the wellbore a perforating sleeve, the perforating sleeve comprising:

an outer housing; and a perforating assembly secured within the outer housing and comprising a perforating cartridge having a first portion disposed within a wall of the outer housing and a second portion protruding into an interior bore of the perforating sleeve, the perforating cartridge having a bore therethrough containing a chemical penetrator;

wherein the second portion of the perforating cartridge protruding into the interior bore of the perforating sleeve provides a bearing surface that upon engagement with an actuating device pumped through the perforating sleeve causes the perforating cartridge to be moved radially outwardly toward the casing;

introducing into the wellbore an actuating device that engages the bearing surface, causing the perforating cartridge to be moved radially outwardly toward the casing; and applying pressure within the inner bore of the perforating sleeve after the radially outward movement of the perforating cartridge, thereby causing the chemical penetrator to react with the casing to create a port therethrough.

18. The method of claim 17 wherein the perforating sleeve further comprises:

an inner sleeve disposed within the outer housing, the inner sleeve being arranged to secure the perforating assembly within the outer housing and being further arranged to be longitudinally movable within the outer housing to close or open the created port;

wherein the perforating cartridge is located in a bore of the inner sleeve having shoulders that serve as a guide so that when the actuating device engages the bearing surface the perforating cartridge will be driven radially outwardly with little longitudinal offset.

19. The method of claim 17 wherein the actuating device is a ball.

20. The method of claim 19 wherein the bearing surface provided by the second portion of the perforating cartridge protruding into the interior bore of the perforating sleeve has a sloped profile that magnifies the force that the ball can apply to the perforating cartridge.

21. The method of claim 17 wherein the bore through the perforating cartridge further comprises a catalyst that increases the effects of the chemical penetrator on the casing.

22. The method of claim 21 wherein the catalyst and chemical perforator are separated by a protective membrane that is ruptured by the pressure applied within the inner bore of the perforating sleeve after the radially outward movement of the perforating cartridge.

23. The method of claim 22 wherein the protective membrane is an elastomer.

24. The method of claim 22 wherein the protective membrane is a metal.

25. The method of claim 21 wherein the chemical penetrator is bromine trifluoride and the catalyst is steel wool.

26. The method of claim 25 wherein the bromine trifluoride is retained within the bore of the perforating cartridge by a rupture disk located in the bore of the perforating cartridge radially inward with respect to the perforating sleeve and by a second rupture disk located between the bromine trifluoride and the steel wool, wherein the steel wool is located in a portion of the bore of the perforating cartridge radially outward with respect to the perforating sleeve, wherein the rupture disks are ruptured by the pressure applied within the inner bore of the perforating sleeve after the radially outward movement of the perforating cartridge.

27. A perforating sleeve adapted to create a port through a casing of a wellbore in which the perforating sleeve is disposed, the perforating sleeve comprising:

an outer housing;

a perforating assembly secured within the outer housing; and an inner sleeve disposed within the outer housing, the inner sleeve being arranged to secure the perforating assembly within the outer housing and being further arranged to be longitudinally movable within the outer housing to close or open the created port;

wherein the perforating assembly comprises a portion protruding into an inner bore of the perforating sleeve and comprises a means for inducing a reaction between a chemical perforator contained within the perforating assembly and the casing upon engagement of the portion of the perforating assembly with an actuating device pumped through the perforating sleeve and further in response to pressure applied within the inner bore of the perforating sleeve thereafter.

28. The perforating sleeve of claim 27 wherein the perforating assembly is secured within the outer housing by threads on a base of the perforating assembly that engage complimentary threads on the outer housing.

29. The perforating sleeve of claim 27 wherein the perforating assembly is radially retained by shear pins.

* * * * *